US007556253B2

(12) United States Patent
Peng et al.

(10) Patent No.: US 7,556,253 B2
(45) Date of Patent: Jul. 7, 2009

(54) AUTO DOCUMENT FEEDER

(75) Inventors: Wei-Yuan Peng, Hsinchu (TW); Min-Hsi Liu, Hsinchu (TW); Wei-Fong Liu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 132 days.

(21) Appl. No.: 11/868,109

(22) Filed: Oct. 5, 2007

(65) Prior Publication Data

US 2009/0091076 A1 Apr. 9, 2009

(51) Int. Cl.
*B65H 5/00* (2006.01)
*B65H 5/22* (2006.01)
*B65H 7/02* (2006.01)

(52) U.S. Cl. ..... 271/3.13; 271/3.15; 271/3.17; 271/10.02; 271/10.03; 271/258.01; 271/265.01

(58) Field of Classification Search ..... 271/3.13, 271/3.15, 3.17, 4.02, 4.03, 10.02, 10.03, 271/258.01, 265.01
See application file for complete search history.

(56) References Cited

U.S. PATENT DOCUMENTS 3,898,930 A * 8/1975 Ikegami et al. ..... 101/316
7,182,336 B2 * 2/2007 Fukushima et al. .... 271/265.01
7,404,558 B2 * 7/2008 Kanome ..... 271/258.05
7,474,872 B2 * 1/2009 Nojima ..... 399/388
2006/0157921 A1 * 7/2006 Ahn et al. ..... 271/258.01
2006/0208415 A1 * 9/2006 Lyu et al. ..... 271/10.02
2007/0075484 A1 * 4/2007 Terada ..... 271/258.01
2007/0284812 A1 * 12/2007 Hirai ..... 271/265.01

* cited by examiner

*Primary Examiner*—David H Bollinger
(74) *Attorney, Agent, or Firm*—WPAT, P.C.; Anthony King

(57) ABSTRACT

An auto document feeder cooperated with an image processing machine defines a feeding path and has a base, a frame and a sensor device. The base has a background under the feeding path. The frame is mounted on the base. The sensor couples with the frame and has a sensor arm. The sensor arm has an optical sensor located in the feeding path and faced to the background of the base. The sensor device recognizes a sheet is present in the feeding path or not by that the optical sensor recognizes the energy of the light reflected from the background and the sheet. The sensor device also recognizes characteristic of the sheet by that the optical sensor recognizes the energy of the light reflected from the sheet. Therefore, the image processing machine executes different processes for the sheet according to the characteristic of the sheet.

17 Claims, 7 Drawing Sheets

AUTO DOCUMENT FEEDER

BACKGROUND OF THE INVENTION

1. Field of the Invention

The invention relates to an auto document feeder. More specifically, an auto document feeder with a sensor device capable of recognizing the characteristic of a sheet and that the sheet is present in a feeding path or not.

2. The Related Art

According to the progress of the image processing technology, many image processing products are popularly used, such as printers, scanners, fax machines, copy machines, etc. According to processing a large amount of documents, an auto document feeder is developed for cooperating with image processing products described above.

The auto document feeder can catch one sheet from a stack of the document and transfers the sheet to the image processing products continuously. Therefore, the image processing products can uninterrupted process a large amount of document without feeding the sheet to the image processing products manually.

A conventional auto document feeder 900 is shown in FIG. 6 and FIG. 7. The auto document feeder 900 cooperates with an image processing product (not shown in figures) and has a base 901 and a frame 902 mounted on the base 901, which defines a feeding path 903. One end of the feed path 903 is arranged a first sensor device 904 mounted on the base 901, and the other end of the feeding path 903 is arranged a second sensor device 905 mounted on the frame 902.

The first sensor device 904 detects material of a sheet (not shown in figures) fed into the feeding path 903 and sends a signal to a processing circuit (not shown in figures) for adjusting operation of sheet processing according to the signal. While different sheets are fed into the feeding path 903, the first sensor device 904 can send different signals to the processing circuit corresponding to the different sheets. The processing circuit therefore adjusts operation of sheet processing, according to the different signals.

The second sensor device 905 has a detecting module 906 and a swing module 907. The swing module 907 has a shaft 908, a first swing arm 909 extending from the shaft 908 in one of radial direction of the shaft 908 and a second swing arm 910 extending from the shaft 908 in another one radiating direction of the shaft 908.

While the swing module 907 mounted on the frame 902, a spring 911 interconnects between the frame 902 and the swing module 907. The swing module 907 is hitched on the frame 902 by the spring 911. The first swing arm 909 of the swing module 907 is located in the feeding path 903 and the second swing arm 910 of the swing module 907 is located to corresponding to the detecting module 906 mounted on the frame 902.

While the sheet is fed into the feeding path 903 and passed through the swing module 907, the sheet pushes the first swing arm 909 of the swing module 907. Therefore, the first swing arm 909 of the swing module 907 is shifted an angle and the second swing arm 910 is shafted same angle together with the first swing arm 909. The detecting module 906 detects shift of the second swing arm 910 of the swing module 907 and sends a signal to the processing circuit to recognize that the sheet is fed into the feeding path.

However, the conventional auto document feeder 900 has a first sensor device 904 and a second sensor device 905 for recognizing material of the sheet and recognizing that the sheet is present in the feeding path 903 or not. Therefore, the cost of the conventional auto document feeder 900 is increased and the structure of the conventional auto document feeder 900 is complex.

While the conventional auto document feeder 900 is shook, the swing module 907 of the second sensor device 905 is moved. While the detecting module 906 detects shift of the second swing arm 910 of the swing module 907 caused by shaking the conventional auto document feeder 900, the detecting module 906 may erroneously recognize that the sheet is fed into the feeding path 903.

SUMMARY OF THE INVENTION

An object of the present invention is to provide an auto document feeder defining a feeding path. The auto document feeder has a base, a frame mounted on the base and a sensor device. The base has a background arranged under the feeding path. The frame has a front wall located above the feeding path, a first engaging base and a second engaging base projected from the front wall, a slot and a through hole opened on the front wall.

The sensor device has a base element defining opposite ends. One end of the base element is projected a spring engaging portion and the other end of the base element is projected a fixing portion for engaging with the second engaging base of the frame. The base element is extended a first engaging portion for coupling with the first engaging base of the frame, a second engaging portion for coupling with the second engaging base of the frame and a sensor arm.

The sensor arm has a supporting portion connected to the base element and arranged above the feeding path, a sensor portion connected to the supporting portion and arranged in the feeding path and an optical sensor arranged at the sensor portion and faced to the background of the base. A spring interconnects between the spring engaging portion of the sensor device and the slot and the through hole of the frame.

The sensor device recognizes that a sheet is present in the feeding path or not according to that the optical sensor recognizes the light reflection factor of the background and the light reflection factor of the sheet. Also, the sensor device recognizes characteristic of the sheet according to that the optical sensor recognizes the light reflection factor of the sheet. While the auto document feeder cooperates with an image processing machine, the image processing machine adjusts the operation of sheet processing according to the characteristic of the sheet.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
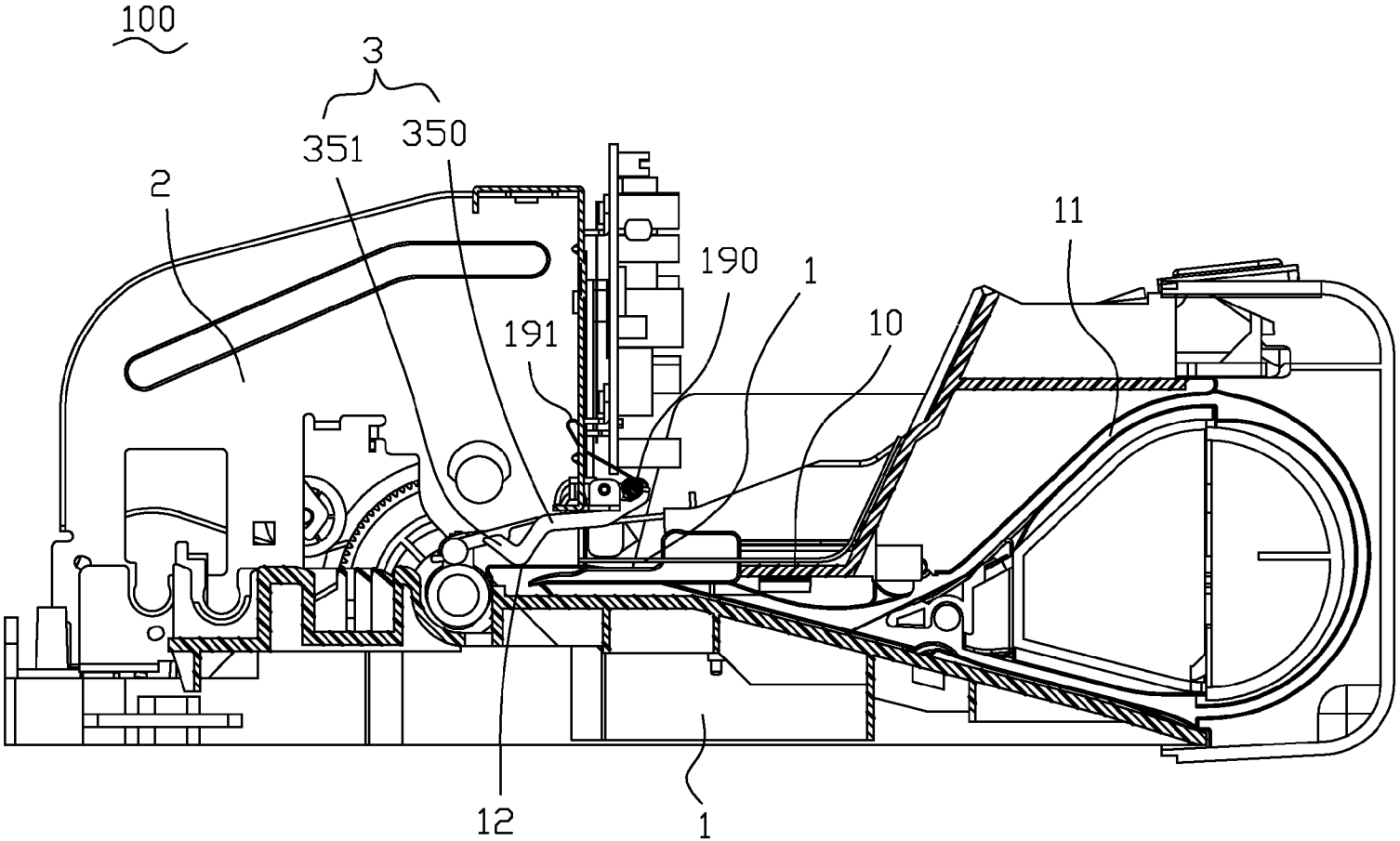
FIG. 1 shows a cross section of an auto document feeder according to the present invention.

Please refer to FIG. 1. A preferred embodiment of the auto document feeder 100 according to the present invention is shown. The auto document feeder 100 has a base 1 and a frame 2 mounted on the base 1. The auto document feeder 100 defines a feeding path 10 and sheet reversing path 11 communicated with the feeding path 10. A sensor device 3 is configured to the frame 2. The base 1 has a background 12 with a predetermined light reflection factor. In this case, the background is black.

Figure 2:
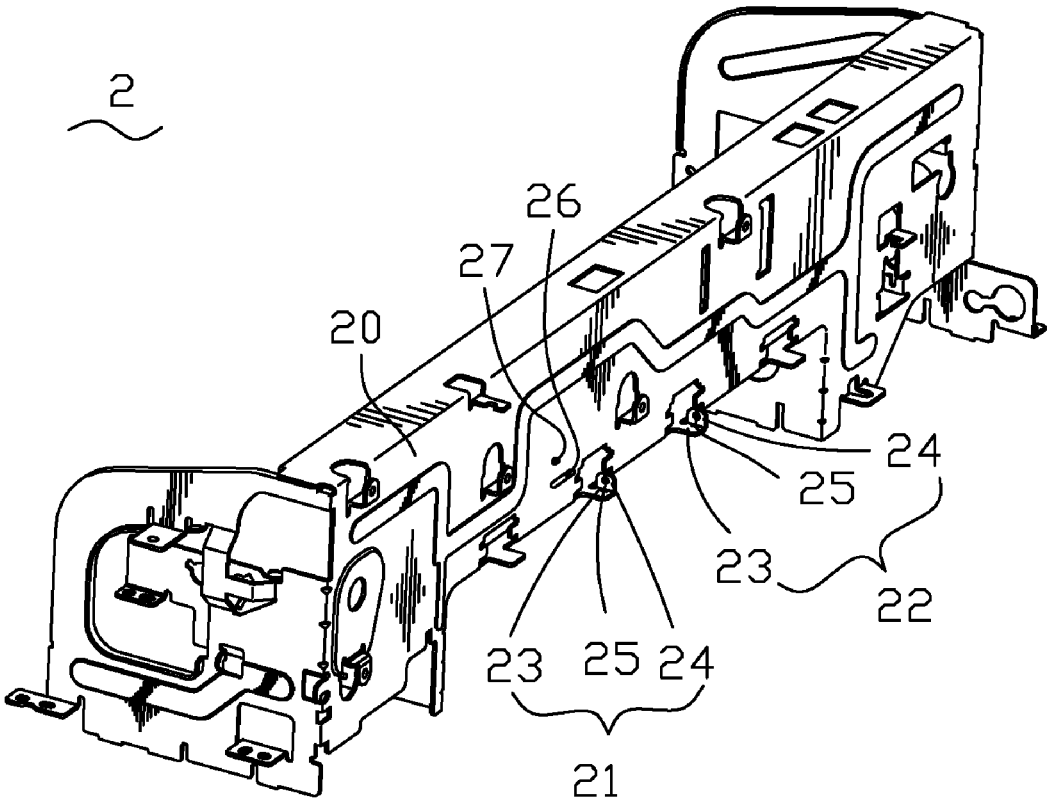
FIG. 2 is a perspective view showing a frame of the auto document feeder according to the present invention.

Please refer to FIG. 2. The frame 2 has a front wall 20 located above the feeding path 10. A first engaging base 21 and a second engaging base 22 spaced from the first engaging base 21 are projected from the front wall 20 of the frame 2 respectively. The first engaging base 21 and the second engaging base 22 have a supporting plate 23 horizontally extending from the front wall 20 of the frame 2, a first fixing plate 24 perpendicular to the supporting plate 23 and a hole 25 opened through the first fixing plate 24.

In this case, the first fixing plate 24 projects upwards and extends from the supporting plate 23. The vicinity of the first engaging base 21 is opened a slot 26. In this case, the slot 26 is horizontally opened on the front wall 20 of the frame 2 and close to the first engaging base 21. The vicinity of the slot 26 is opened a through hole 27. In this case, the through hole 27 is opened above the slot 26.

Figure 3:
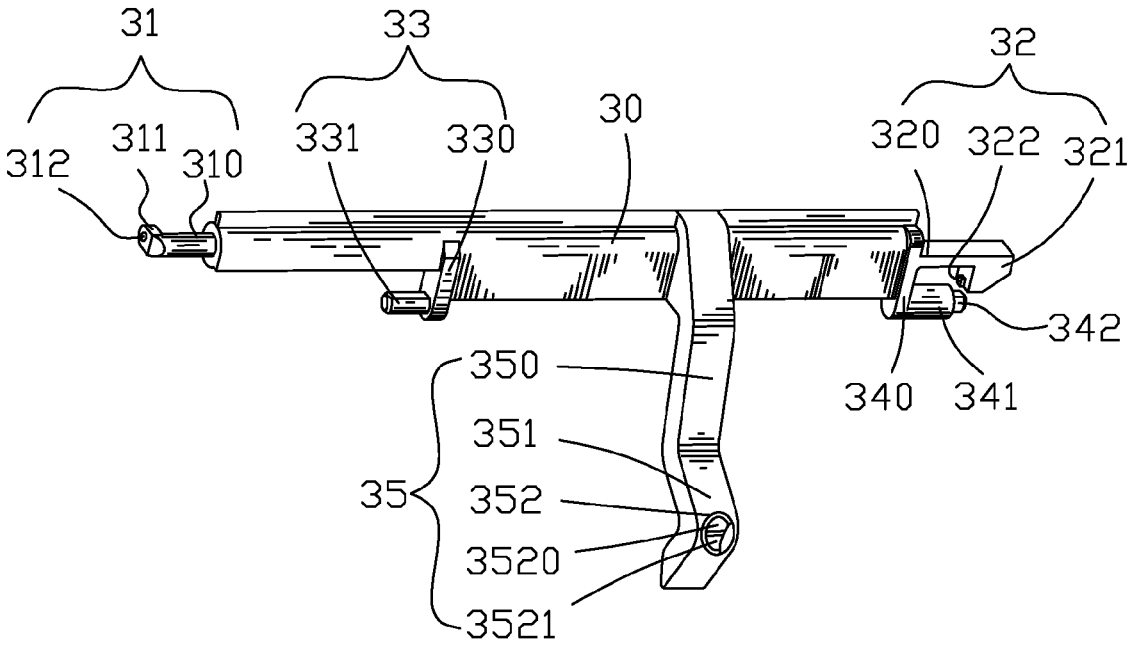
FIG. 3 is a top view showing a sensor device of the auto document feeder according to the present invention.
Figure 4:
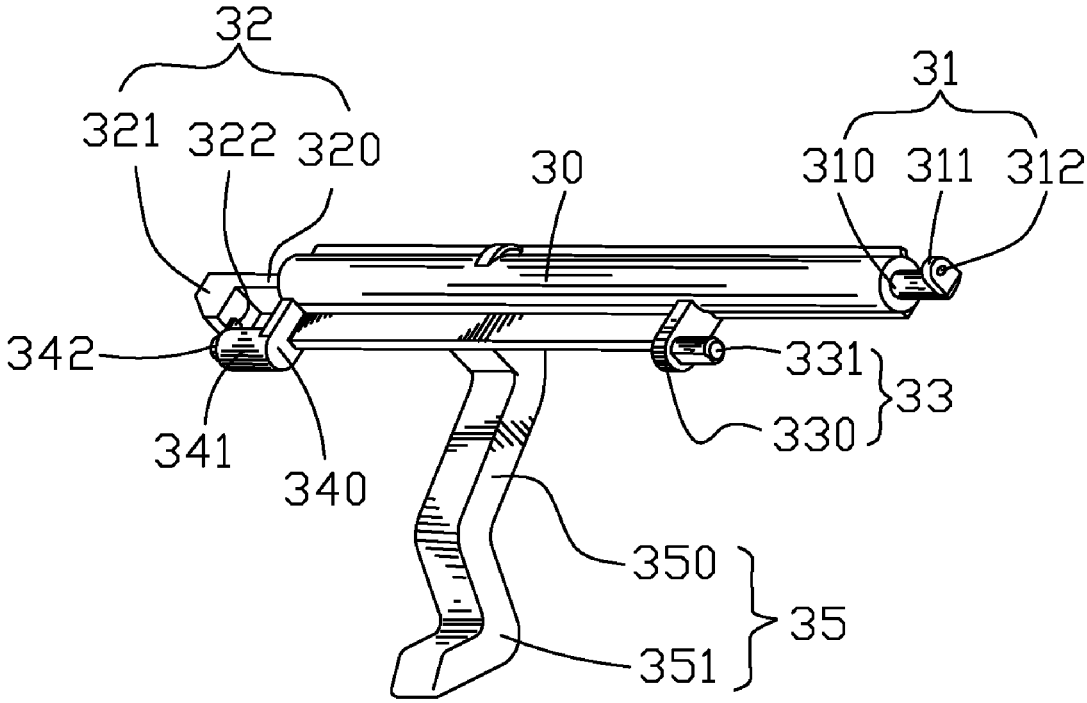
FIG. 4 is a bottom view showing the sensor device of the auto document feeder according to the present invention.
Figure 5:
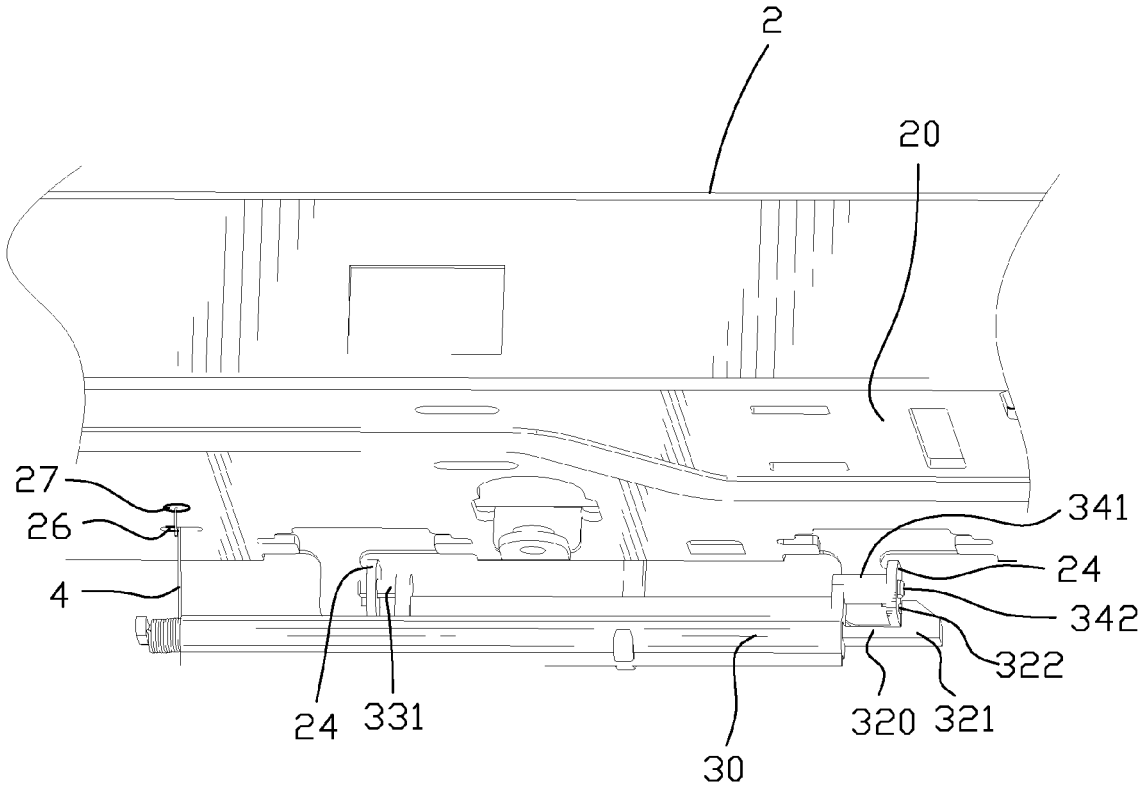
FIG. 5 shows the sensor device configured to the frame of the auto document feeder according to the present invention.
Figure 6:
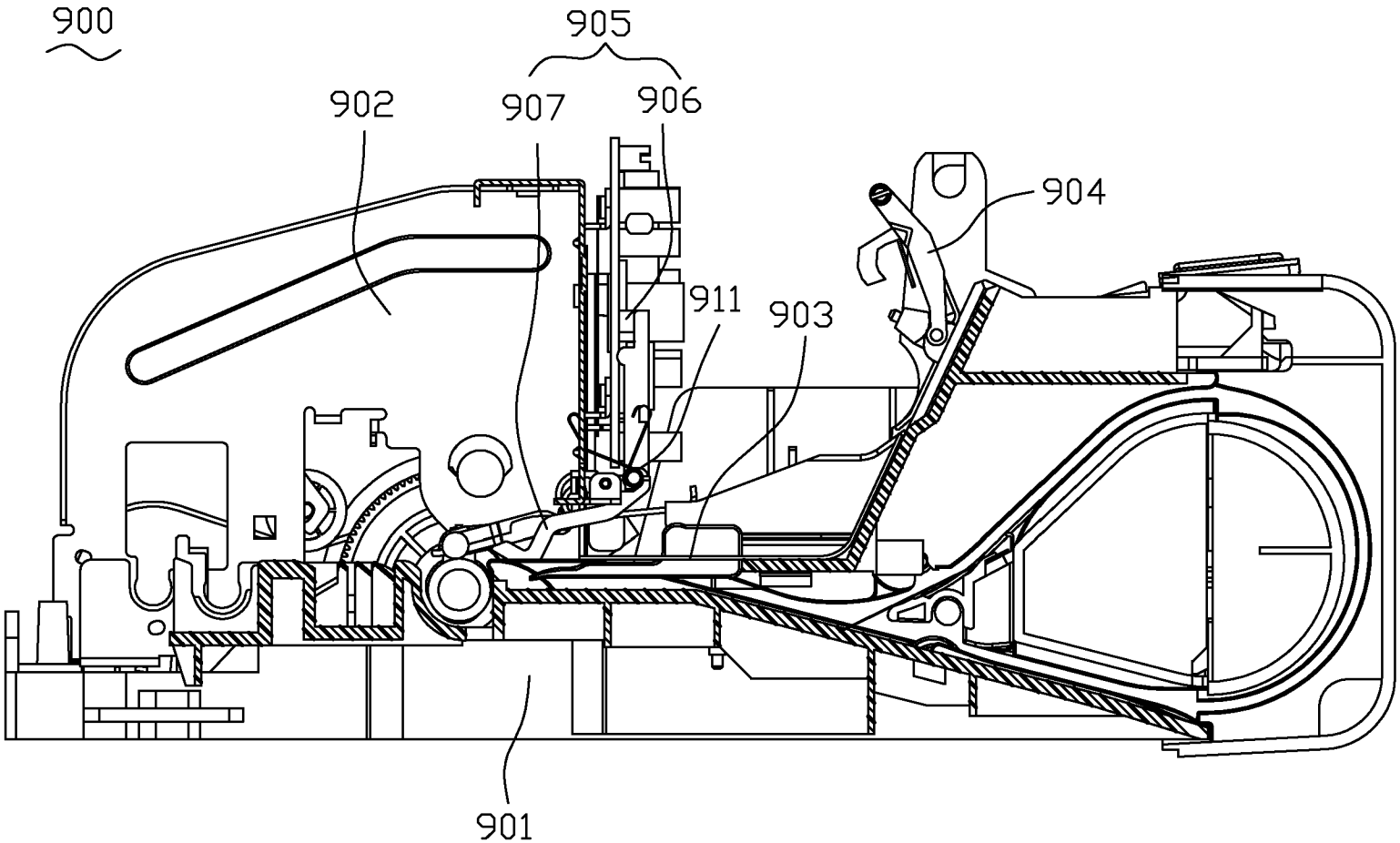
FIG. 6 shows a cross section of a conventional auto document feeder.
Figure 7:
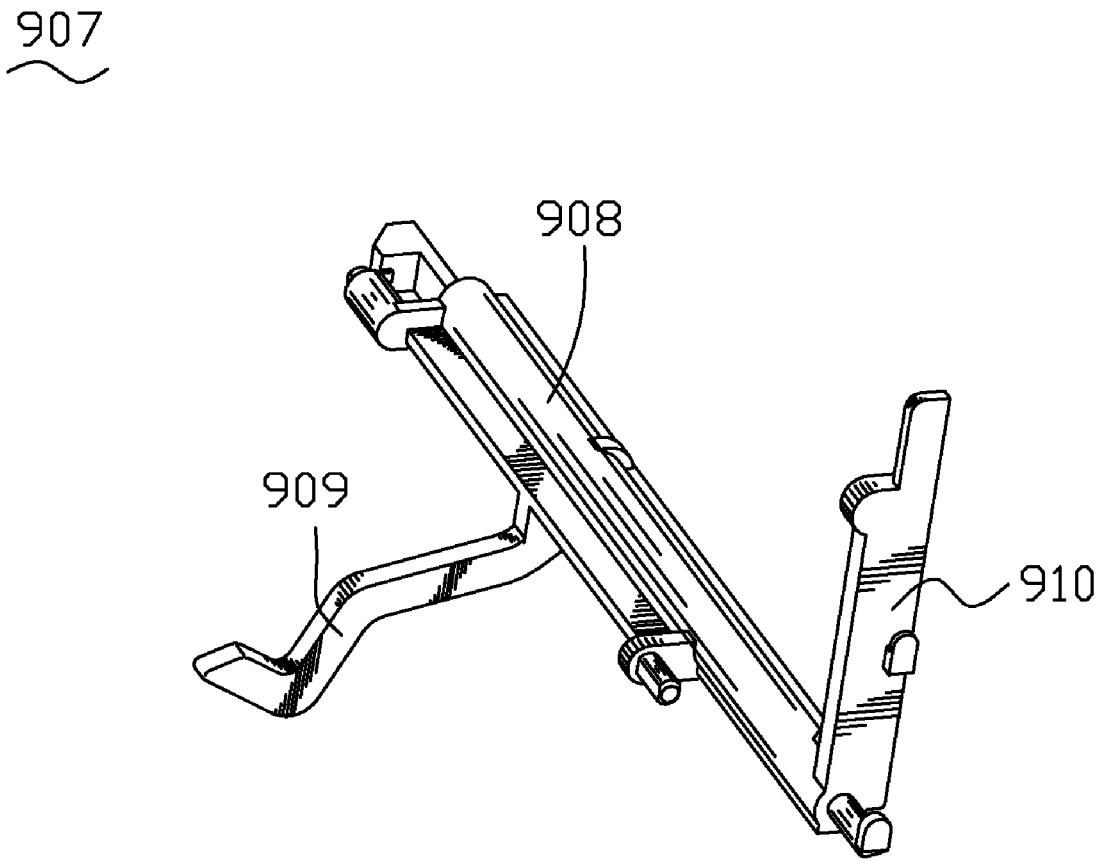
FIG. 7 is a perspective view showing a swing module of a second sensor device of the conventional auto document feeder.

Please refer to FIG. 3 and FIG. 4. The sensor device 3 has a processing circuit (not shown in figures) and a base element 30. In this case, the base element 30 is formed as a post shape and defined opposite ends. One end of the base element 30 is projected a spring engaging portion 31 along axial direction of the base element 30. In this case, the spring engaging portion 31 has a first post 310 projected from one end of the base portion 30 along axial direction of the base element 30, a first protrusion 311 extending from free end of the first post 310 and perpendicular to the first post 310, and an engaging hole 312 opened on the first protrusion 311.

The other end of the base element 30 is projected a fixing portion 32. The fixing portion 32 has an elastic arm 320 projected from the other end of the base portion 30 along axial direction of the base element 30, a block 321 extending from free end of the elastic arm 320 and perpendicular to the elastic arm 320, and a second protrusion 322 projected from the block 321.

The base element 30 has a first engaging portion 33, a second engaging portion 34 and a sensor arm 35. The first engaging portion 33 has a first engaging plate 330 projected from the base element 30 along radial direction of the base element 30 and a first shaft 331 projected from the first engaging plate 330. In this case, the first shaft 331 is perpendicular to the first engaging plate 330. The first shaft 331 of the first engaging portion 33 and the first post 310 of the spring engaging portion 31 project to same direction.

The second engaging portion 34 has a second engaging plate 340 projected from the base element 30 along radial direction of the base element 30, a second post 341 projected from the second engaging plate 340, and a second shaft 342 projected from freed end of the second post 341 along axial direction of the second post 341. In this case, the second post 341 is perpendicular to the second engaging plate 340. The second post 341 and the second shaft 342 of the second engaging portion 34 and the elastic arm 320 of the fixing portion 32 project to same direction. The block 321 of the fixing portion 32 is projected towards the second shaft 342 of the second engaging portion 34.

The sensor arm 35 extends from the base element 30 along radial direction of the base element 30. The sensor arm has a supporting portion 350 extending from the base element 30, a sensor portion 351 connecting to the supporting portion 350 and a sensor 352 having a light-emitting diode (LED) 3520 and a receiver 3521 and mounted on the sensor portion 351 and connected to a processing circuit (not shown in figures). In this case, the sensor portion 351 is formed as a curved-shape. The sensor 352 is mounted on tip of the sensor portion 351.

Please refer to FIG. 1 to FIG. 5. The sensor device 3 is configured to the frame 2 by engagement of the first engaging base 21 of the frame 2 and the first engaging portion 33 of the sensor device 3, and engagement of the second engaging base 22 of the frame 2 and the second engaging portion 34 of the sensor device 3. In this case, the first shaft 331 of the first engaging portion 33 of the sensor device 3 is received in the hole 25 of the first engaging base 21 of the frame 2. The second shaft 342 of the second engaging portion 34 of the sensor device 3 is received in the hole 25 of the second engaging base 22 of the frame 2.

The fixing plate 24 of the second engaging base 22 is pressed to between the second post 341 of the second engaging portion 34 and the block 321 of the fixing portion 32. The second protrusion 322 of the fixing portion 32 presses the fixing plate 24 of the second engaging base 22 by the elastic force of the elastic arm 320 of the fixing portion 32. Therefore, the sensor arm 35 of the sensor device 3 is pivoted on the frame 2 by the first shaft 331 of the first engaging portion 33 and the second shaft 342 of the second engaging portion 34.

The first post 310 of the spring engaging portion 31 is surrounded a spring coil 4. One end of the spring coil 4 is clasped to the engaging hole 312 of the spring engaging potion 31. The other end of the spring coil 4 is passed through the slot 26 of the frame 2 and clasped to the through hole 27 of the frame 2.

According to the engagement of the first engaging portion 33 of the sensor device 3 and the first engaging base 21 of the frame 2, the engagement of the second engaging portion 34 of the sensor device 3 and the second engaging portion 35 of the second engaging base 22 and the engagement of the spring engaging portion 31 of the sensor device 3, the spring coil 4 and the slot 26 and the through hole 27 of the frame 2, the sensor device 3 is hitched on the frame 2.

In this case, the supporting portion 350 of sensor arm 35 of the sensor device 3 is located upon the feeding path 10 and the tip of the sensor portion 351 is located on the feeding path 10. Therefore, the sensor 352 of the sensor arm 35 of the sensor device 3 is arranged on the feeding path 10. While a sheet (not shown in figures) is fed to the feeding path 10 and passed through the sensor portion 351 of the sensor arm 35 of the sensor device 3, the sensor portion 351 is pressed on the front surface of the sheet else the sensor portion 351 of the sensor arm 35 of the sensor device 3 is pressed on the background 12 of the base 1.

While the sheet is fed in the feeding path 10 and passed through the sensor portion 351 of the sensor arm 35 of the sensor device 3, the LED 3520 of the sensor 352 illuminates the front surface of the sheet. According to the material of the sheet with individual reflection ratio, the receiver 3521 of the sensor 35 receives different light energy while different sheets are passed through the sensor portion 351 of the sensor device 3.

Because the different light energy are reflected form the different sheets and received by the receiver 3521 of the sensor 35, the sensor 35 sends different signals corresponding to the different light energy to the processing circuit. The processing circuit executes different processes for different sheets according to different signals received from the sensor 35 of the sensor device 3.

For example, the processing circuit adjusts the amount of the ink printed on the sheet according to different signals received from the sensor 35 of the sensor device 3 while the auto document feeder 100 cooperates with a printer (not shown in figures). While the sheet 6 is not fed through the sensor portion 351 of the sensor device 3, the LED 3520 of the sensor 352 illuminates the black area of the base 1. Because reflection ratio of the black area is the lowest, the receiver 3521 receives few light energy Therefore, the processing circuit recognizes "no sheet" while the light energy received by the receiver 3521 of the sensor device 35 is below the predetermined threshold.

After the printer prints ink on the front surface of the sheet 6, the sheet 6 is fed into the sheet reversing path 11. The black surface of the sheet 6 is passed through the sensor portion 351 of the sensor device 35 after the sheet 6 is extracted from the sheet reversing path 11 and fed into the feeding path 10. The sensor device 3 detects material of the sheet again as described above.

Therefore, the sensor device 3 provides different signals to the processing circuit according to the status of the sheet such as material of the sheet and present of the sheet in the feeding path 10. The processing circuit can execute different processes according to different signals.

Furthermore, the present invention is not limited to the embodiments described above; various additions, alterations and the like may be made within the scope of the present invention by a person skilled in the art. For example, respective embodiments may be appropriately combined.

What is claimed is:

1. An auto document feeder defining a feeding path, comprising:

a base having a background under said feeding path;

a frame mounted on said base and having a front wall located upon said feeding path, a first engaging base and a second engaging base formed on said front wall, a slot and a through hole opened on said front wall;

a sensor device engaged to said frame, which has a base element defining opposite ends, a spring engaging portion projected from one end of said base element along axial direction of said base element, a fixing portion projected from the other end of said base element along axial direction of said base element and engaged with said second engaging base of said frame, a first engaging portion extended from said base element and coupled with said first engaging base of said frame, a second engaging portion extended from said base element and coupled with said second engaging base of said frame, and a sensor arm extended from said base element along radial direction of said base element, said sensor arm having a supporting portion located upon said feeding path, a sensor portion located in said feeding path and a sensor arranged at said sensor portion and faced to said background of said base and;

a spring interconnected between said spring engaging portion of said sensor device and said slot and said through hole of said frame.

2. The auto document feeder as claimed in claim 1, wherein said first engaging base and said second engaging base respectively have a supporting plate projected from said front wall of the frame, a first fixing plate extended from and perpendicular to said supporting plate and a hole opened through said fixing plate.

3. The auto document feeder as claimed in claim 2, wherein said supporting plate horizontally projected from said front wall of the frame, said first fixing plate extended upwards from said supporting plate.

4. The auto document feeder as claimed in claim 3, wherein said slot is close to said first engaging base, said through hole is opened above said slot.

5. The auto document feeder as claimed in claim 4, wherein said slot is horizontally opened on said front wall of said frame.

6. The auto document feeder as claimed in claim 1, wherein said base element is formed as a post shape.

7. The auto document feeder as claimed in claim 6, wherein said spring engaging portion has a first post projected from one end of said base portion along axial direction of said base element, a first protrusion extended from free end of said first post and an engaging hole opened on said first protrusion.

8. The auto document feeder as claimed in claim 7, wherein said first protrusion is perpendicular to the first post.

9. The auto document feeder as claimed in claim 8, wherein said fixing portion has an elastic arm projected from the other end of said base portion along axial direction of said base element, a block extended from free end of said elastic arm, and a second protrusion projected from said block.

10. The auto document feeder as claimed in claim 9, wherein said block is perpendicular to said elastic arm.

11. The auto document feeder as claimed in claim 10, wherein said second engaging portion has a second engaging plate projected from said base element along radial direction of said base element, a second post projected from said second engaging plate, and a second shaft projected from freed end of said second post along axial direction of said second post.

12. The auto document feeder as claimed in claim 11, wherein said second post is perpendicular to said second engaging plate, said second post and said second shaft of said second engaging portion and said elastic arm of said fixing portion project to same direction, said block of said fixing portion is projected towards said second shaft of said second engaging portion.

13. The auto document feeder as claimed in claim 7, wherein said spring is a spring coil surrounded the first post of the spring engaging portion of the sensor device, one end of the coil spring is clasped to the engaging hole of the spring engaging potion, the other end of the spring coil is passed through the slot of the frame and clasped to the through hole of the frame.

14. The auto document feeder as claimed in claim 1, wherein said first engaging portion has a first engaging plate projected from said base element along radial direction of said base element and a first shaft projected from said first engaging plate.

15. The auto document feeder as claimed in claim 14, wherein said first shaft is perpendicular to said first engaging plate, said first shaft of said first engaging portion and said spring engaging portion are projected to same direction.

16. The auto document feeder as claimed in claim 1, wherein said sensor has a light-emitting diode and a receiver.

17. The auto document feeder as claimed in claim 16, wherein said sensor portion is formed as a curved-shape, said sensor is arranged at tip of said sensor portion.

* * * * *